US010821455B2

(12) United States Patent
Brunt et al.

(10) Patent No.: US 10,821,455 B2
(45) Date of Patent: Nov. 3, 2020

(54) SPRAYING DEVICE AND METHOD OF USING SAME

(71) Applicant: Reckitt Benckiser (Brands) Limited, Slough (GB)

(72) Inventors: James Edward Brunt, Salt Lake City, UT (US); Martin Butler, Kwun Tong (HK); Avijit Das, Hull (GB); Richard Gamble, Slough (GB); David Sanders, Warwick (GB); Christopher Witty, Hull (GB); Simon Woolley, Hull (GB)

(73) Assignee: Reckitt Benckiser (Brands) Limited, Slough (GB)

( * ) Notice: Subject to any disclaimer, the term of this patent is extended or adjusted under 35 U.S.C. 154(b) by 208 days.

(21) Appl. No.: 15/752,103

(22) PCT Filed: Sep. 19, 2016

(86) PCT No.: PCT/GB2016/052914
§ 371 (c)(1),
(2) Date: Feb. 12, 2018

(87) PCT Pub. No.: WO2017/046614
PCT Pub. Date: Mar. 23, 2017

(65) Prior Publication Data

US 2018/0236473 A1 Aug. 23, 2018

(30) Foreign Application Priority Data

Sep. 18, 2015 (GB) ..... 1516544.2

(51) Int. Cl.
*B05B 11/00* (2006.01)
*B65D 83/38* (2006.01)
*B65D 83/26* (2006.01)

(52) U.S. Cl.
CPC ..... *B05B 11/0054* (2013.01); *B05B 11/0038* (2018.08); *B05B 11/0091* (2013.01); *B65D 83/384* (2013.01); *B65D 83/262* (2013.01)

(58) Field of Classification Search
CPC ..... B05B 11/0054; B05B 11/0038; B05B 11/0091; B65D 83/384; B65D 83/262
(Continued)

(56) References Cited

U.S. PATENT DOCUMENTS 2,966,283 A * 12/1960 Darvie ..... B65D 83/386 222/183
3,347,423 A * 10/1967 Babbin ..... B65D 83/24 222/183

(Continued)

FOREIGN PATENT DOCUMENTS

CN 104137047 A 11/2014
FR 2673608 A1 9/1992

(Continued)

OTHER PUBLICATIONS

International Search Report and Written Opinion of the International Searching Authority for corresponding application PCT/GB2016/052914 dated Dec. 19, 2016.

(Continued)

*Primary Examiner* — Vishal Pancholi
(74) *Attorney, Agent, or Firm* — Norris McLaughlin PA

(57) ABSTRACT

A spraying device for spraying fluid from a replaceable refill is described, the refill comprising a refill body containing a reservoir of fluid to be sprayed, a valve stem in fluid communication with the reservoir and a spray head mounted on the valve stem, the spray head having a spray exit nozzle, wherein the spraying device comprises a housing with a releasably engagable top portion and base portion; wherein the base portion is configured to retain at least a lower (Continued)

portion of the refill body therein and wherein the top portion has a spray opening and holds an actuation mechanism, and wherein the top portion further comprises an alignment means for cooperation with the spray opening wherein alignment is provided to the refill spray head, in use, by a radially-spaced ledge substantially co-axial with the valve stem of the refill, the ledge being provided with an at least partially hollow core to receive at least a portion, in use, of the refill spray head, and wherein the ledge extends downwardly from the top portion toward the base portion such that the ledge adjacent the spray opening extends less than the rearmost part of the ledge that is remote from the spray opening which extends furthermost. A method of using the spraying device is also described.

13 Claims, 3 Drawing Sheets

(58) Field of Classification Search
USPC ..... 222/182
See application file for complete search history.

(56) References Cited

U.S. PATENT DOCUMENTS 3,534,890 A * 10/1970 Iannacone ..... B65D 83/386 222/402.14
3,589,570 A 6/1971 Gach
4,132,333 A * 1/1979 Debard ..... B65D 83/206 222/402.13
5,358,147 A * 10/1994 Adams ..... B65D 83/386 222/183
5,839,623 A 11/1998 Losenno
5,875,934 A * 3/1999 Miller ..... B65D 83/206 222/183
6,036,108 A 3/2000 Chen
6,569,387 B1 * 5/2003 Furner ..... A01M 1/2033 222/183
8,079,498 B2 * 12/2011 Anderson ..... A61L 9/14 222/183
8,328,122 B2 * 12/2012 Bedford ..... B65D 83/384 239/589
8,459,508 B2 * 6/2013 Westphal ..... B65D 83/386 222/131
2007/0181609 A1 * 8/2007 Rymer ..... B65D 83/205 222/402.1

FOREIGN PATENT DOCUMENTS

GB 1194367 6/1970
GB 1512869 6/1978
JP 2013244432 A 12/2013
RU 2243252 C1 12/2004
WO 2011151295 A1 12/2011

OTHER PUBLICATIONS

GB Search Report for corresponding application GB1516544.2 dated Mar. 1, 2016.
RU Search Report for corresponding application RU 2018113977 dated Jan. 14, 2020.

* cited by examiner

SPRAYING DEVICE AND METHOD OF USING SAME

This is an application filed under 35 USC 371 based on PCT/GB2016/052914 filed 19 Sep. 2016, which in turn is based on GB 1516544.2 filed 18 Sep. 2015. The present application claims the full priority benefit of these prior applications and herein incorporates by reference the full disclosures of these prior applications.

FIELD OF THE INVENTION

The present invention relates to improvements in devices for spraying a fluid and particularly, but not exclusively to devices for spraying fluids such as fragrances, deodorizing fluids and/or a pest control material or the like.

BACKGROUND

Prior art devices for spraying fragrances, deodorising agents and sanitising fluids into a room generally consist of a device containing a removable source of fluid. With such an arrangement once the source of fluid has been completely exhausted, the source can be replaced rather than replacing the entire device. Typically such sources come in many forms including containers, bottles, canisters and cartridges (generically, all such containers, bottles, cans and cartridges hereinafter will be referred to as "refills"). Such refills can be pump sprays or aerosols, including metered and non-metered versions thereof.

Known prior art devices are typically provided with a recess to permit wall mounting and with a flat base to permit the device to be free standing on a flat surface. These devices typically comprise a two-part housing of a main body and a cover, the main body holds an actuation mechanism typically consisting of an electrically powered motor, gears, actuation arm, batteries and the like. The main body is further provided with a refill receiving means which typically is formed of a support plate at or adjacent the base to support the base of a refill. The main body is further provided with a support channel adjacent the actuation mechanism, the support channel being present to laterally support a spray head of the refill during actuation, ie—during depression of the spray head by the actuation arm of the actuation mechanism during operation to spray a quantity of fluid from the refill out into the surrounding environment through the spray head. The cover is provided with a spray opening configured to be adjacent the support channel such that an exit nozzle of the spray head will face the opening to permit, in use, sprayed fluid to exit the device. The main body and cover are connected via a hinge adjacent the base of the device to form a closure via a clamshell arrangement to seal the refill inside the device. There are also examples of prior art where the hinge is provided along the side of the main body to produce the clamshell arrangement.

Despite the prior art devices being commonplace, or perhaps because of their commonplace nature, there is a surprisingly high incident rate of users inserting a refill improperly and causing damage to the refill and/or the device in the process. Reported incidents include, but are not limited to: inserting the refill forcefully such that the spray head is not located within the support channel and instead impinges against a covering over the actuation mechanism resulting in the snapping of a valve stem to which the spray head is mounted; inserting the refill into the device such that the exit nozzle of the spray head is facing the interior of the device rather than where the opening in the cover will be when the cover and main body are closed against each other, this is problematic as the closing of the cover pushes a body of the refill into the device and since the spray head bears against the interior of the device the closing cover causes the valve stem to bend and then snap; failure to note when the actuation arm is fully or partially blocking the support channel, such as when the actuation mechanism has activated in the absence of a refill or when the spring pressure in the refill valve is under specified such that once the content of the refill has been consumed and there is insufficient pressure within the refill from the valve spring in combination with the pressurised content to push the actuation arm back to its starting position, the user can then cause the valve stem to snap when attempting to force the spray head into the support channel or cause the valve stem to snap when closing the cover which pushes the body of the refill into the device and the valve stem bend against the actuation arm before snapping; and variations of these actions.

It is an object of the present invention to remove, reduce or ameliorate the above-mentioned drawbacks.

SUMMARY OF INVENTION

According to a first aspect of the present invention there is provided therefore a spraying device for spraying fluid from a replaceable refill comprising a refill body containing a reservoir of fluid to be sprayed, a valve stem in fluid communication with the reservoir and a spray head mounted on the valve stem, the spray head having a spray exit nozzle, wherein the spraying device comprises a housing with a releasably engagable top portion and base portion; wherein the base portion is configured to retain at least a lower portion of the refill body therein and wherein the top portion has a spray opening and holds an actuation mechanism, and wherein the top portion further comprises an alignment means for cooperation with the spray opening wherein alignment is provided to the refill spray head, in use, by a radially-spaced ledge substantially co-axial with the valve stem of the refill, the ledge being provided with an at least partially hollow core to receive at least a portion, in use, of the refill spray head, and wherein the ledge extends downwardly from the top portion toward the base portion such that the ledge adjacent the spray opening extends less than the rearmost part of the ledge that is remote from the spray opening which extends furthermost.

The device of the present invention may be advantageous in providing a device in which a user is incapable of incorrectly placing or replacing a refill therein since regardless of the orientation of the spray head on insertion, as the top portion of the device housing and the base portion of the device housing are brought into engagement with each other the alignment means will contact the spray head of the refill and rotate the spray head about its valve stem on which it is mounted such that the spray exit nozzle is facing the spray opening in the housing. Alternatively if the torque to overcome is lower, the action of bringing the top portion of the device housing and the base portion of the device housing into engagement with each other may permit the alignment means to contact the spray head of the refill and may cause the rotation of the valve stem to which the spray head is mounted such that the spray exit nozzle is facing the spray opening in the housing.

The spray head of the refill is preferably provided with a generally L-shaped profile, wherein the shorter part of the L-shape engages with the free end of the valve stem and the spray exit nozzle is located at the end of the longer part of the L-shape. An upper surface of at least the longer part of the L-shape may have a curved profile. Preferably the spray head of the refill for use with the device of the present invention is generally L-shaped with an angle of substantially 90° between the part of the spray head connected to the valve stem and the part of the spray head possessing the exit orifice; this angle may be between 60-120° however.

Preferably the radial-spacing of the ledge is of a substantially consistent radius. The ledge preferably has a substantially completely hollow core, this may ensure that various shapes of spray head may be easily accommodated within the alignment means. The ledge preferably extends downwardly from the part(s) of the ledge adjacent the spray opening to the rearmost part thereof. The ledge preferably extends downwardly at a substantially constant gradient from the part(s) of the ledge adjacent the spray opening to the rearmost part thereof. Even more preferably the ledge extends downwardly at a substantially constant gradient from the part(s) of the ledge adjacent the spray opening to a part adjacent the rearmost part whereupon it extends downwardly at a steeper gradient to the rearmost part. The rearmost part of the ledge preferably terminates in a point, this may be advantageous in that in the event of the rearmost part of the ledge contacting the spray head the point thereof will more conveniently permit the rotation thereof. The substantially consistent radius may be advantageous as the ledge can contact a localised impingement point of the spray head of a refill. The impingement point may be suitably shaped to best interact with the ledge, for instance it may be preferable for the impingement point on the refill spray head to possess a curved profile to reduce friction as the spray head is rotated by contact with the ledge. The constant gradient may be advantageous as it may facilitate a smoother rotation of the spray head about its valve stem as the spray head is rotated through contact at the impingement point by the alignment means.

Refills are typically provided with a radial valve crimp at or adjacent their uppermost surface, preferably the ledge is provided with an outer diameter that is less than the inner diameter of the radial valve crimp.

The part of the ledge adjacent the spray opening may be provided with a recess or non-extension (ie—does not extend downwardly) to capture the spray head when located therein. Most preferably the part of the ledge adjacent the opening is partially or substantially or completely absent to provide a support channel to receive the spray head when located therein. The support channel may be advantageous as it reduces or removes any impingement between the ledge and the spray head at the end of any rotation which may assist in preventing any accidental actuation of the refill valve during the act of replacement. The support channel may also permit greater flexibility of refill height tolerance which in turn may also permit greater flexibility in selecting an engagement mechanism between the base and top portion of the housing. Furthermore the support channel may also permit a wider selection of actuation mechanisms since the spray head may be laterally supported during actuation by the actuation means against any movement imparted to the spray head thereby which is not co-axial with the valve stem of the spray head.

Preferably the ledge of the alignment member is provided by a ridge, preferably the ridge has a width of <1.0 cm, and more preferably a width of <0.6 cm, and most preferably a width of <0.3 cm. The narrower the ridge the smaller the impingement point on the spray head which may be advantageous when designing a suitable surface on the spray head which may function as the impingement point.

The ledge or ridge may be coated with a low-friction material to improve the ability of the alignment member to rotate the refill spray head when contacting same at the impingement point. Alternatively or additionally the ledge or ridge may be made from a low friction material, such a low friction polymers and/or self-lubricating polymers.

Most preferably the top portion and the base portion of the device housing are brought into engagement with each other whilst one or both portions are rotated relative to each other. Rotational movement is preferred as it may result in a more robust inter-operation between the alignment means and the spray head.

An engagement mechanism to provide a releasably secure engagement between the top portion and the base portion of the device may be provided. Preferably the engagement mechanism engages and disengages by a user applying rotational force to one or both of the top portion of the device housing and/or base portion of the device housing. Most preferably the engagement mechanism is provided by a bayonet arrangement. A bayonet arrangement is preferred as this provides a defined engagement point at which a user can easily determine whether the two housing portions are engaged thus ensuring that the alignment member has successfully rotated the spray head such that the exit nozzle thereof is facing the spray opening of the housing. Alternatively the engagement mechanism may be provided by a screw thread.

Alternatively the top portion and the base portion of the device housing may be brought into engagement with each other without rotation or without substantial rotation via push-fit arrangement. Where engagement between the top portion and base portion is provided without rotation or without substantial rotation, the engagement mechanism may be a push-fit connection or the like.

The actuation mechanism preferably comprises an electrically powered motor with one or more gears connected to the motor and an actuation arm connected to at least one of the motor or the gears. The actuation mechanism may further comprise batteries, a control unit, user-operable control input means.

The base portion of the device housing is configured to retain at least a lower portion of the refill therein, preferably refill retaining means are provided to hold a base of the refill. The refill retaining means may be provided in the form of a platform or one or more tabs which support a base of the refill at a predetermined point in the base portion which permits the spray head of the refill to be located at a height which permits the actuation mechanism to actuate, in use, the refill by depressing the spray head when the top portion of the housing is engaged with the base portion. Most preferably however, the refill retaining means are provided by one or more refill straps. Said one or more refill straps are preferably formed by an L-shaped member wherein the longer part of the member is mounted or formed on an inner surface of the base portion to permit flexibility and/or hinged rotation thereabout and extends downwardly to permit the shorter part of the member to project toward a central point of the base portion and are configured to contact the base of the refill. Said one or more refill straps are preferably biased such that the longer part of the member is biased out of contact with the inner surface of the base portion housing. Preferably between 2 and 6 refill straps are provided, and most preferably 4 refill straps are provided.

The spraying device housing may be provided with any outer shape. Preferably the spraying device housing defines a generally cylindrical shape wherein the top portion is provided by a generally cylindrically-shaped housing which is open at one end to permit entry to the upper portion of the refill and the bottom portion is provided by a generally cylindrically-shaped housing to permit entry to the lower portion of the refill. The top portion may further comprise a lid remote from the open end and which is accessible from the exterior of the device, the lid may provide a cover to one or more of: a battery compartment, the actuation mechanism, user input controls. The base portion may comprise a generally cylindrical side wall connected to a base wall, preferably where refill straps are provided the base portion is not provided with a base wall.

The device of any of the above-mentioned aspects may be provided with an indicator wherein said indicator is operable to indicate information to a user. The indicator may be operable to provide a visual indication and/or provide an audible indication. Preferably the indicator is configured to provide a visual indication by emitting light from one or more light sources, preferably one or more LEDs. The one or more light sources may be adapted to emit a different colour of light to indicate the current function the device is performing. Additionally or alternatively, the one or more light sources may blink or flash to indicate the current function the device is performing.

The device may be provided with a boost mechanism. The boost mechanism may be linked to a user operated switch or button or the like. On operating the boost mechanism the actuation means may activate to cause the immediate actuation of a refill.

The device may be power by mains-supplied electricity and/or be battery powered and/or be powered by solar cells located on the device. Most preferably the device is battery powered.

According to a second aspect of the present invention there is provided therefore a computer-readable medium having computer-executable instructions adapted to cause a 3D printer to print a spraying device for spraying fluid from a replaceable refill comprising a refill body containing a reservoir of fluid to be sprayed, a valve stem in fluid communication with the reservoir and a spray head mounted on the valve stem, the spray head having a spray exit nozzle, wherein the spraying device comprises a housing with a releasably engagable top portion and base portion; wherein the base portion is configured to retain at least a lower portion of the refill body therein and wherein the top portion has a spray opening and holds an actuation mechanism, and wherein the top portion further comprises an alignment means for cooperation with the spray opening wherein alignment is provided to the refill spray head, in use, by a radially-spaced ledge substantially co-axial with the valve stem of the refill, the ledge being provided with an at least partially hollow core to receive at least a portion, in use, of the refill spray head, and wherein the ledge extends downwardly from the top portion toward the base portion such that the ledge adjacent the spray opening extends less than the rearmost part of the ledge that is remote from the spray opening which extends furthermost.

According to a third aspect of the present invention there is provided a method of orientating a spray head of a replaceable refill of fluid when loading same into a spraying device for spraying fluid from said replaceable refill wherein the replaceable refill comprises a refill body containing a reservoir of fluid to be sprayed, a valve stem in fluid communication with the reservoir and a spray head mounted on the valve stem, and the spray head having a spray exit nozzle and wherein the spraying device comprises a housing with a releasably engagable top portion and base portion; wherein the base portion is configured to retain at least a lower portion of the refill body therein and wherein the top portion has a spray opening and holds an actuation mechanism, and wherein the top portion further comprises an alignment means for cooperation with the spray opening wherein alignment is provided to the refill spray head, in use, by a radially-spaced ledge substantially co-axial with the valve stem of the refill, the ledge being provided with an at least partially hollow core to receive at least a portion, in use, of the refill spray head, and wherein the ledge extends downwardly from the top portion toward the base portion such that the ledge adjacent the spray opening extends less than the rearmost part of the ledge that is remote from the spray opening which extends furthermost; wherein the method comprises the steps of: locating a the refill body in the base portion of the spraying device; and bringing the top portion of the spraying device into engagement with the base portion such that the ledge of the alignment means contacts the refill spray head to rotate same about the valve stem until the refill spray head is located where the ledge extends least and with the spray exit nozzle facing the spray opening in the top portion.

For the avoidance of doubt, all of the features disclosed in this specification and/or all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is one example only of a generic series of equivalent or similar features.

BRIEF DESCRIPTION OF THE DRAWINGS

Embodiments of the invention will now be described, by way of example only, with reference to the following drawings in which.

DESCRIPTION OF AN EMBODIMENT

Figure 1:
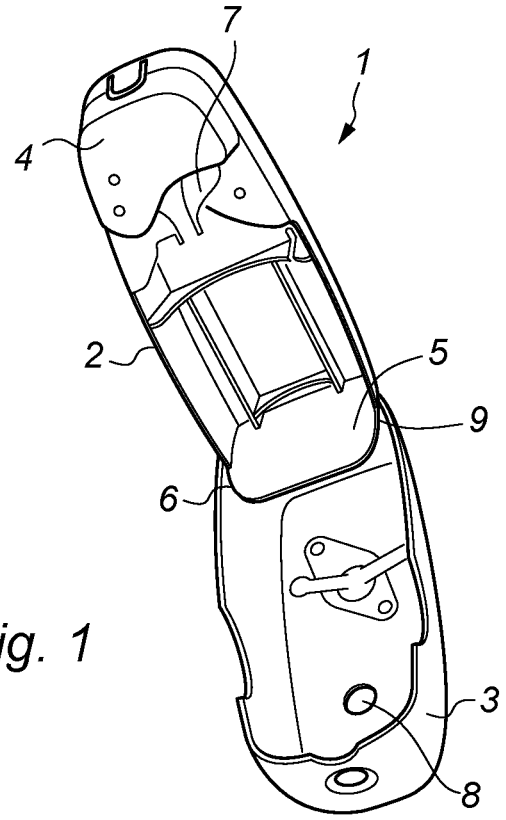
FIG. 1 illustrates a prior art device.

A prior art spraying device 1 is shown in FIG. 1 and comprises a two-part housing of a main body 2 and a cover 3 connected via a hinge 9 adjacent a base 6 of the main body 2 to form a closure via a clamshell arrangement to seal, in use, a refill inside the device 1. As can be seen, the main body 2 holds an actuation mechanism (not shown) under an inner housing 4, the actuation mechanism consists of an electrically powered motor, gears, actuation arm and batteries to power same. The main body 2 is provided with a support plate 5 adjacent its base 6 to support the base of a refill (not shown). The inner housing 4 is provided with a support channel 7 adjacent the actuation mechanism, the support channel 7 being present to laterally support a spray head of the refill during actuation, ie—during depression of the spray head by the actuation arm of the actuation mechanism during operation to spray a quantity of fluid from the refill out into the surrounding environment through the spray head. The cover 3 is provided with a spray opening 8 configured to be adjacent the support channel 7 when in a closed clamshell arrangement such that an exit nozzle of the spray head will face the opening to permit, in use, sprayed fluid to exit the device.

Without careful location of the refill into the prior art device 1, the user can inadvertently damage the refill. Some of the common incidents of damage include a user inserting the refill forcefully such that the spray head is not located within the support channel 7 and impinges against the inner housing 4 to cause the valve stem to snap. Additionally users have commonly inserted the refill into the device such that the exit nozzle on the spray head is facing the interior of the device rather than where the spray opening 8 will be when the cover 3 is closed against the and main body 2, this is problematic as the closing of the cover 3 pushes a body of the refill into the device 1 and since the spray head bears against an interior surface of the support channel 7 the closing cover causes the valve stem to bend and then snap. A further common problem is a user failing to note when the actuation arm (not shown) is fully or partially blocking the support channel 7, such as when the previous refill has been consumed and there is insufficient pressure within the refill to push the actuation arm back to its starting position, the user can then cause the valve stem to snap when attempting to force the spray head into the support channel 7 or by closing the cover 3 which pushes the body of the refill into the device 1 and causes the valve stem to bend against the actuation arm before snapping.

Figure 2:
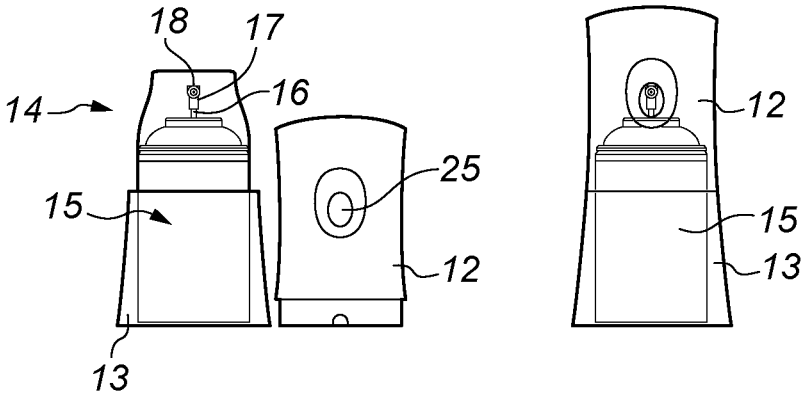
FIG. 2 illustrates a disassembled device according to the present invention.
Figure 3:
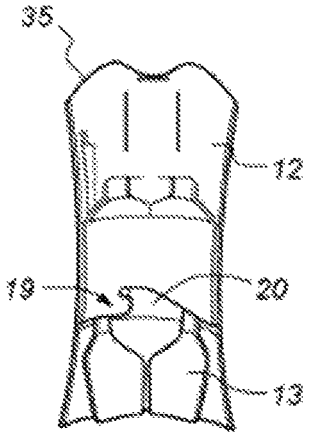
FIG. 3 illustrates a cross-sectional view of a device according to the present invention.

Turning to FIGS. 2&3 a device 10 according to the present invention is illustrated. The device 10 comprises a housing 11 which is composed of a top portion 12 and a base portion 13. A refill 14 is provided here as an aerosol canister of pressurised fluid but could be a bottle or container or a cartridge or such like holding a reservoir of fluid to be sprayed. The refill 14 comprises a refill body 15 containing the reservoir of fluid to be sprayed, a valve stem 16 in fluid communication with the reservoir and a spray head 17 mounted on the valve stem 16, the spray head having a spray exit nozzle 18. The refill 14 can be housed within the device 10 by the top portion 12 being located over the top of the refill 14 and lowered until an engagement mechanism 19, shown in FIG. 3 as a bayonet fitting 20, releasably securely connects the top portion 12 and the base portion 13. During the lowering of the top portion 12 an alignment means 21 contacts and imparts rotation movement to the spray head 17 to orientate same relative to the spray opening 25 and that will be discussed below in relation to FIGS. 4&5.

Figure 4:
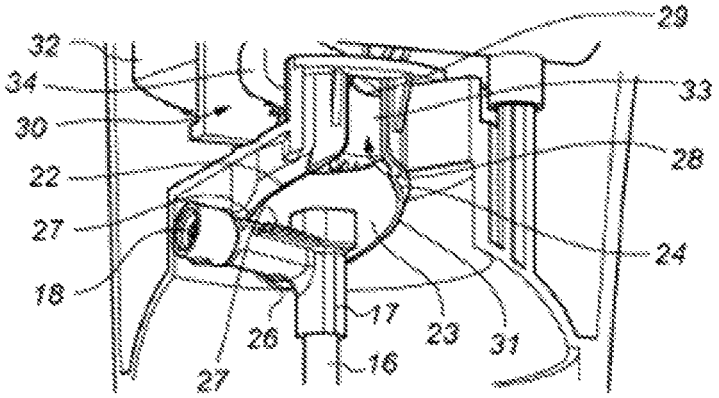
FIG. 4 illustrates a view of the interior of a device according to the present invention.
Figure 5:
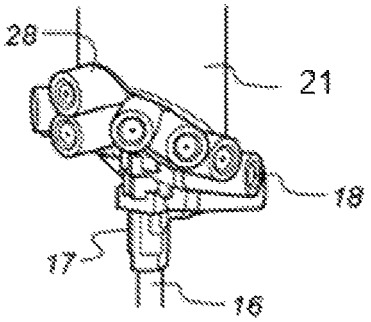
FIG. 5 illustrates a time-lapse view of rotation applied to a refill spray head by the alignement means of a spray device according to the present invention.

In FIG. 4 a sectional view of the top portion 12 is shown to better describe the features of the alignment means 21 and their inter-operation with the refill spray head 17. The alignment means 21 is provided by a radially-spaced ledge 22 substantially co-axial with the valve stem 16 of the refill 14. The ledge 22 is provided with an at least partially hollow core 23 to receive at least a portion of the refill spray head 17 therein. The ledge 22 extends downwardly from the top portion 12 toward the base portion 13 such that the ledge 22 has a section 24 adjacent the spray opening 25 that extends less than the rearmost part 26 of the ledge 22 that is remote from the spray opening 25 which extends furthermost.

The radial-spacing of the ledge 22 may be of a substantially consistent radius. The hollow core 23 permits spray heads of various shapes of spray head ease of entry thereto. The consistent radius may be advantageous as the ledge 22 can contact a localised impingement point 27 of the refill spray head 17. The impingement point 27 may be suitably shaped to best interact with the ledge, for instance it may be preferable for the impingement point 27 on the refill spray head 17 to possess a curved profile to reduce friction as the spray head 17 is rotated by contact with the ledge 22, as discussed below.

The ledge 22 may extend downwardly at a substantially constant gradient from the section 24 of the ledge adjacent the spray opening 25 to the rearmost part 26 of the ledge 22. The constant gradient may be advantageous as it may facilitate a smoother rotation of the spray head 17 about the valve stem 16 as the spray head 17 is rotated through contact at the impingement point 27 by the alignment means 21, as discussed further below.

As shown in FIG. 4, the section 24 of the ledge 22 adjacent the spray opening 25 is formed to provide a recess 28 (ie—does not extend downwardly) to capture the spray head 17 when located therein. Most preferably the recess 28 is formed to closely match the lateral proportions of the spray head 17 in order to provide a support channel 29 to receive the spray head 17 when located therein and laterally support same during actuation by an actuation mechanism 30 which preferably comprises an electrically powered motor 32 with one or more gears 33 connected to the motor 32 and an actuation arm 34 connected to at least one of the motor 32 or the gears 33 which, in use, can extend into the recess 28 or support channel 29 to contact the spray head 17 and depress same to open a valve within the refill 14 to allow fluid to flow from the reservoir into the spray head 17 and out of the spray exit nozzle 18.

The ledge 22 is preferably provided by a ridge 31 since this will afford the use of less raw materials and potentially advantageously reduce the size of the impingement point 17.

Figure 6:
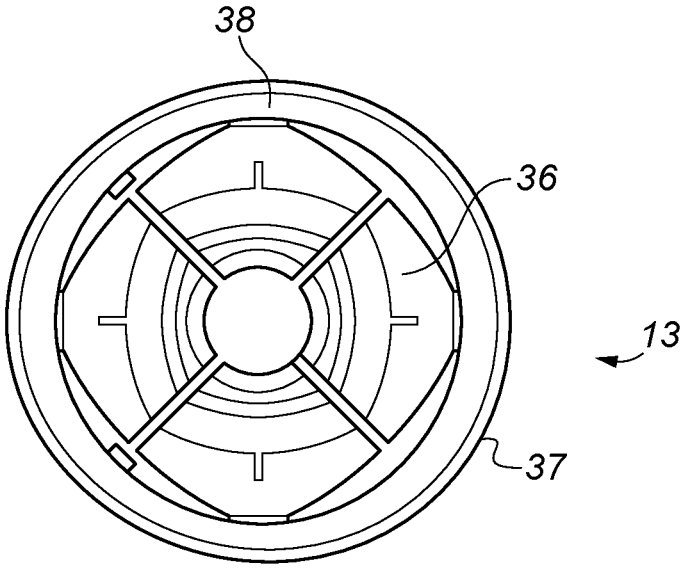
FIG. 6 illustrates a cross-sectional view of a base portion of a device according to the present invention.
Figure 7:
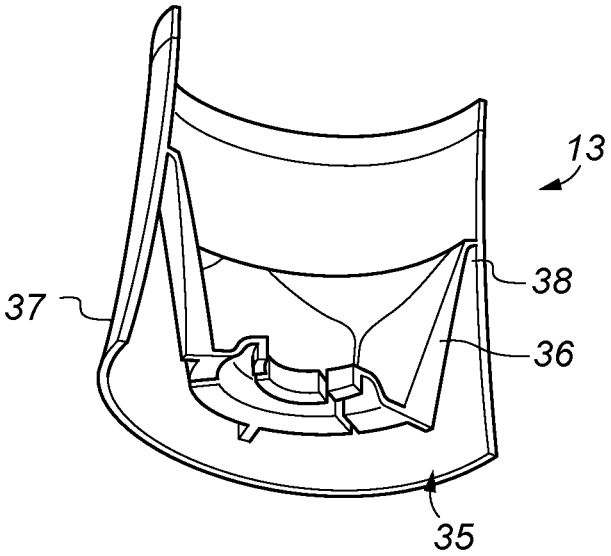
FIG. 7 illustrates an underneath view of a base portion of a device according to the present invention.

Turning to FIGS. 1,6 &7 the base portion 13 of the housing 11 is illustrated. The base portion 13 is configured to retain at least a lower portion of the refill 14 therein. Refill retaining means are provided by a plurality of refill straps 35 formed by an L-shaped member 36 wherein the longer part of the member is mounted or formed on an inner surface 37 of the base portion 13 to permit flexibility and/or hinged rotation at the intersection 38. Each member 37 extends downwardly such that the shorter part of each member 37 projects toward a central point of the base portion 13, said shorter parts of the member 13 are configured to contact a base of the refill 14 and hold it at a predetermined location within the base portion 13. The refill straps 35 are preferably biased such that the longer part of the member 37 is biased out of contact with the inner surface 37 of the base portion 13.

The operation of the alignment means 21 on the refill spray head 17 will now be described. A user first loads the refill 14 into the base portion 13, the orientation of the spray head 17 is irrelevant. The user then locates the top portion 12 over the refill 14 and starts to move either or both of the top portion 12 and the base portion 13 toward each other with the aim of eventually causing the engagement mechanism 19 to releasably secure the top portion 12 to the base portion 13. The act of moving the top portion 12 toward the base portion 13 requires the user to move the top portion 12 downwardly relative to the base portion 13 and rotate the top portion 12 relative the base portion 13 in order for the engagement mechanism to be secured. The movement imparted by the user to the top portion 12 causes at least a portion of the spray head 17 to enter the hollow core of the alignment means 21, further downward movement causes the ridge 31 to contact the spray head 17 at the impingement point 27. Further downward movement causes the spray head 17 to rotate by virtue of following the gradient of the ridge 31 toward a lower part thereof until the spray head 17 is located in the recess 28 (or support channel 29 if present) which in turn will mean that the spray exit nozzle 18 will be directly facing the spray opening 25 and the engagement mechanism will be releasably securely engaged.

The spraying device 10 preferably defines a generally cylindrical shape wherein the top portion 12 is provided with a lid 35 that is remote from an open end, the lid 35 being accessible from the exterior of the device and may be hinged (hinge not shown). Preferably the lid provides a cover to one or more of: a battery compartment, the actuation mechanism, user input controls.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A spraying device configured to spray a fluid from a replaceable refill comprising a refill body containing a reservoir of fluid to be sprayed, a valve stem in fluid communication with the reservoir and an L-shaped spray head mounted on the valve stem which is rotatable about the axis of the valve stem, the spray head having a spray exit nozzle, wherein the spraying device comprises a housing with a rotatably releasably engagable top portion and base portion; wherein the base portion is configured to retain at least a lower portion of the refill body therein and wherein the top portion has a spray opening and holds an actuation mechanism, and wherein the top portion further comprises an alignment means for cooperation with the spray opening wherein alignment is provided to the refill spray head, in use, by a radially-spaced ledge substantially co-axial with the valve stem of the refill, the ledge being provided with an at least partially hollow core to receive at least a portion, in use, of the refill spray head, and wherein the ledge includes a curved part which extends downwardly from the top portion toward the base portion such that the ledge adjacent the spray opening extends less than the rearmost part of the ledge that is remote from the spray opening which extends furthermost, wherein rotational engagement of the top portion and the base portion causes rotation of the spray head against the curved part of the ledge and when the top portion and the base portion are fully engaged, the spray exit nozzle is oriented with the spray opening.

2. The spraying device according to claim 1, wherein the radial-spacing of the ledge is of a substantially consistent radius.

3. The spraying device according to claim 1, wherein the ledge has a substantially completely hollow core.

4. The spraying device according to claim 1, wherein the curved part of the ledge extends downwardly at a substantially constant gradient from the part(s) of the ledge adjacent the spray opening to the rearmost part thereof.

5. The spraying device according to claim 1, wherein the part of the ledge adjacent the spray opening is partially or substantially or completely absent said part being a support channel to receive the spray head when located therein.

6. The spraying device according to claim 1, wherein the ledge of the alignment member is provided by a ridge having a width of <1.0 cm.

7. The spraying device according to claim 1, wherein the ledge or ridge is coated with a low-friction material.

8. The spraying device according to claim 1, wherein an engagement mechanism to provide a releasably secure engagement between the top portion and the base portion of the device is provided.

9. The spraying device according to claim 8, wherein the engagement mechanism engages and disengages by a user applying, in use, rotational force to one or both of the top portion of the device housing and/or base portion of the device housing.

10. The spraying device according to claim 9, wherein the engagement mechanism is provided by a bayonet arrangement.

11. The spraying device according to claim 9, wherein the engagement mechanism is provided by a screw thread.

12. The spraying device according to claim 6, wherein the ledge of the alignment member is provided by a ridge having a width of <0.6 cm.

13. The spraying device according to claim 12, wherein the ledge of the alignment member is provided by a ridge having a width of <0.3 cm.

* * * * *